US007641769B2

(12) United States Patent
Masaki

(10) Patent No.: US 7,641,769 B2
(45) Date of Patent: Jan. 5, 2010

(54) SUCTION BOX AND DEHYDRATOR WITH PRESSURIZATION AND FORMING MACHINE USING THEREOF

(75) Inventor: Junyu Masaki, Handa (JP)

(73) Assignee: Nichiha Corporation, Nagoya-shi (JP)

( * ) Notice: Subject to any disclaimer, the term of this patent is extended or adjusted under 35 U.S.C. 154(b) by 410 days.

(21) Appl. No.: 11/581,750

(22) Filed: Oct. 17, 2006

(65) Prior Publication Data

US 2008/0087399 A1 Apr. 17, 2008

(51) Int. Cl.

| | |
|---|---|
| ***D21F 1/52*** | (2006.01) |
| ***B29C 41/16*** | (2006.01) |
| ***D21J 1/04*** | (2006.01) |
| ***D21J 1/06*** | (2006.01) |

(52) U.S. Cl. ..... 162/364; 162/363; 162/399; 425/85; 34/581

(58) Field of Classification Search ..... 162/211, 162/217, 351, 352, 363, 364, 366, 374, 210, 162/205, 214, 225, 227, 398, 399; 34/581; 264/86, 87; 425/84, 85

See application file for complete search history.

(56) References Cited

U.S. PATENT DOCUMENTS

| | | | | |
|---|---|---|---|---|
| 2,740,332 | A * | 4/1956 | Van Ryzin | 162/374 |
| 3,194,729 | A * | 7/1965 | Robinson | 162/374 |
| 3,266,977 | A * | 8/1966 | Gatke | 162/374 |
| 5,076,894 | A * | 12/1991 | Simmons et al. | 162/352 |
| 5,630,910 | A * | 5/1997 | McPherson | 162/352 |
| 2004/0238142 | A1 * | 12/2004 | Bartelmuss et al. | 162/353 |

FOREIGN PATENT DOCUMENTS

| | | |
|---|---|---|
| JP | 2555851 | 8/1997 |
| JP | 3482879 | 10/2003 |

* cited by examiner

*Primary Examiner*—Eric Hug
(74) *Attorney, Agent, or Firm*—Birch, Stewart, Kolasch & Birch, LLP

(57) ABSTRACT

The present invention is a suction box for dehydrating the intermediate form of an inorganic building board during manufacturing or dehydrating the material slurry which is eventually molded into inorganic building boards. The suction box can change the open area ratio of dehydration space easily and can be used with pressure forming machines. The suction box has a frame member with a bottom plate, plural bridge members, plural spacer members and a pair of fixture members. The open area ratio is the space formed between each bridge member, including an interval with the bridge member and an outer frame portion in the frame member with the bottom plate.

3 Claims, 13 Drawing Sheets

SUCTION BOX AND DEHYDRATOR WITH PRESSURIZATION AND FORMING MACHINE USING THEREOF

BACKGROUND OF THE INVENTION

1. Field of the Invention

The present invention is related to the suction box which dehydrates when building board such as inorganic board is molded and dehydrator with pressurization and forming machine using thereof.

2. Description of the Related Art

The following description sets forth the inventor's knowledge of related art and problems therein and should not be construed as an admission of knowledge in the prior art.

Conventionally, in house, inorganic building board can be used as external wall material, roofing material, external element material or interior wall material. And manufacturing process as referred to as wet process is overused when inorganic building board is produced. In this wet process, water is added in raw material for building boards abundantly, and raw material becomes liquid slurry. And material slurry flows down on water permeability sheet such as felts, and forming molds intermediate of a building board. A suction box is placed under water permeability sheet such as the felts which is flowed down material slurry, extra water is dehydrated through the sheet by aspiration. In addition, it drains the unnecessary water to a suction box that there is in intermediate of inorganic building board by keep pressurizing with the use of dehydrator with pressurization having a suction box. By this, content of water in intermediate of a building board is decreased, and it is molded in the shape of a plate, and it makes cure, and inorganic building board is produced afterwards.

For example, for suction box used conventionally, there is suction box 9 shown in FIGS. 16 and 17. Steel perforated panel 93 is arranged to this suction box 9, wherein steel perforated panel 93 is made from lot of water drip holes 931, wherein lot of water drip holes 931 are formed on plural elongated protruding portions 923, wherein plural elongated protruding portions 923 are formed to bottom plate portion 921 in frame member with bottom plate 92. And intermediate of building board 8 containing water 81 is put on suction box 9, and this intermediate of building board 8 is kept pressurizing by a pair of presses 96, and vacuum aspiration does suction box 9 with an aspirator. Then, Water 81 included in intermediate of building board 8 goes along lot of water drip holes 931 of steel perforated panel 93, and it flows down to suction box 9. In suction box 9, the water which flowed down goes along passage 924 formed in an interval between plural elongated protruding portions 923, and it is drained of water by external of suction box 9.

As thus described, for suction box 9 dehydrating water 81 by lot of water drip holes 931, there is manufacturing apparatus of cement mortal molded product disclosed by Japanese utility model No. 2,555,851. In this manufacturing apparatus, drip steel plate (steel perforated panel 93) includes a lot of vacuum holes for dehydration (water drip holes 931). Here, opening area per unit area by vacuum hole for dehydration in peripheral portion is larger than thereof of center portion. By this, cement mortal molded product placed in a peripheral portion of drip steel plate by facing is aspirated chiefly, and cement mortal molded product superior in a good appearance and physical property is produced.

In addition, in Japanese patent No. 3,482,879, the suction box which plural plates are aligned every uniformity, and formed dehydration hole of a slit between plates next to each other is disclosed. In this suction box, each plates are fitted as against plural rails installed in the upper surface releasably. By this, a replacement of each plates becomes simple and easy, and hour to need for maintenance is shortened.

However, in the conventional suction box, there are the following problems.

When intermediate of building board is dehydrated by suction box of Japanese utility model No. 2,555,851 or Japanese patent No. 3,482,879, there is the case that lot of water drip holes 931 (vacuum hole for dehydration) in steel perforated panel 93 (drip steel plate) make clogging by one part of materials of intermediate of building board. Therefore it is necessary to clean regularly to cancel clogging.

In addition, in Japanese patent No. 3,482,879, it is difficult to adjust opening area ratio of dehydration space of a slit formed between plates. In other words the installation number of plate cannot be changed so that installation position of plural rails is fixed in Japanese patent No. 3,482,879. Therefore, for change of opening area ratio of dehydration space, it can deal only by changing thickness of plate.

The description herein of advantages and disadvantages of various features, embodiments, methods, and apparatus disclosed in other publications is in no way intended to limit the present invention.

For example, certain features of the preferred embodiments of the invention may be capable of overcoming certain disadvantages and/or providing certain advantages, such as, e.g., disadvantages and/or advantages discussed herein, while retaining some or all of the features, embodiments, methods, and apparatus disclosed therein.

SUMMARY OF THE INVENTION

The preferred embodiments of the present invention have been developed in view of the above-mentioned and/or other problems in the related art.

The preferred embodiments of the present invention can significantly improve upon existing methods and/or apparatuses.

Among other potential advantages, some embodiments can provide the suction box which maintenance is easy, and can change opening area ratio of dehydration space easily, and dehydrator with pressurization and forming machine using thereof.

According to one aspect of some embodiments of the present invention, suction box uses in case to dehydrate intermediate of inorganic building board containing water or case to dehydrate water from material slurry.

As for the first invention, suction box comprises frame member with bottom plate, plural bridge members, plural spacer members and a pair of fixture members, wherein the frame member with bottom plate comprises bottom plate portion, outer frame portion formed circumferentially of bottom plate portion, the plural elongated protruding portions which are on bottom plate portion and are parallel each other, and they are elongated from one end towards another end, wherein the plural bridge members are parallel each other, and they are rectangle in the direction which is perpendicular to elongated protruding portion, and they are installed on elongated protruding portion, wherein the plural spacer members install on each elongated protruding portions in an interval between bridge members, wherein a pair of fixture members install on ends of bridge member, and bridge member is fixed in frame member with bottom plate.

Suction box of the present invention installs bridge members and spacer members on plural elongated protruding portions of frame member with bottom plate alternately. In addition, bridge member of rectangle turns a long side to the direction which is perpendicular to the direction which elongated protruding portion forms, and it is installed. Therefore dehydration space opening towards the upper part is formed in interval between bridge member (it is included between outer frame portion in bridge member and frame member with bottom plate).

When described above suction box is used, and intermediate of building board containing water is dehydrated, intermediate of building board is put on suction box. And intermediate of building board can be dehydrated in water in intermediate of building board falling over described above dehydration space in suction box. In addition, it is possible for rapid and effective to dehydrate intermediate of building board by aspirating suction box with the use of an aspirator. Dehydration of material slurry with the use of suction box is the same, too.

In addition, bridge member can be removed from frame member with bottom plate when inessential felt in described above suction box is removed by removing a pair of fixture members. Therefore maintenance of suction box can be performed easily.

In addition, in described above suction box, bridge member is fixed in frame member with bottom plate by using fixture member. Therefore it is not necessary to form fastening hole to fix bridge member in frame member with bottom plate, and it can make reduce manufacturing cost of suction box.

In addition, an application number of bridge member is changed by performing changes of thickness of spacer member to use, and opening area ratio of dehydration space formed between each bridge members can be changed easily. Opening area ratio of dehydration space shows opening area by space formed between each bridge member (including an interval with bridge member and outer frame portion in frame member with bottom plate).

By means of the constitution, the suction box which maintenance is easy, and can change opening area ratio of dehydration space easily can be provided.

The second invention is dehydrator with pressurization comprising suction box of the first invention, water permeability sheet to place over suction box and a pair of presses, wherein a pair of presses is comprised to keep pressurizing suction box, water permeability sheet and intermediate of building board containing water.

Dehydrator with pressurization of the present invention uses suction box having a superior effect of described above. Therefore maintenance of suction box of dehydrator with pressurization of the present invention is easy, and opening area ratio of dehydration space can be changed easily. In addition, for example, for described above water permeability sheet, nonwoven fabric cloths such as felts can be used.

And the third invention is forming machine comprising suction box in the first invention and the endless water permeability sheet which is installed on a suction box, and rotate. Material slurry is put on endless water permeability sheet, and it is constitution aspirating water by suction.

According to the forming machine of the present invention, maintenance of suction box of forming machine is easy, and opening area ratio of dehydration space can be changed easily.

The above and/or other aspects, features and/or advantages of various embodiments will be further appreciated in the following description in conjunction with the accompanying figures.

Various embodiments can include and/or exclude different aspects, features and/or advantages where applicable.

In addition, various embodiments can combine one or more aspect or feature of other embodiments where applicable.

The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED INVENTION

It is explained about preferred detailed description of the preferred embodiment in the first invention.

At first, it is preferable for spacer member to comprise spacer main body and a pair of leg portions. In addition, spacer main body comprises a pair of tilting surfaces formed in the shape of a mountain, wherein a pair of leg portions is formed by lower part of spacer main body, and it makes engage on both sides of elongated protruding portion. In this case, spacer member can be installed in stability in elongated protruding portion because a pair of leg portions sandwiches elongated protruding portion. In addition, when intermediate of building board is put on suction box, and it dehydrates, the water that dropped on spacer member drifts over a pair of tilting surfaces formed in the shape of a mountain, and it flows down in suction box. Therefore intermediate of building board can be dehydrated still more easily.

In addition, it is preferable for a pair of fixture members to have overall length to fix bridge members every predetermined numbers in frame member with bottom plate. In this case, bridge members of predetermined numbers can be removed from frame member with bottom plate by removing a pair of fixture members. Therefore, only bridge member needing disassembly can be easily removed partially.

DESCRIPTION OF THE PREFERRED EMBODIMENTS

In the following paragraphs, some preferred embodiments of the invention will be described with reference to the attached drawings by way of example and not limitation.

It should be understood based on this disclosure that various other modifications can be made by those in the art based on these illustrated embodiments.

Embodiment 1

Embodiment of suction box and dehydrator with pressurization, forming machine using thereof of the present invention is explained below with a drawing.

Figure 1:
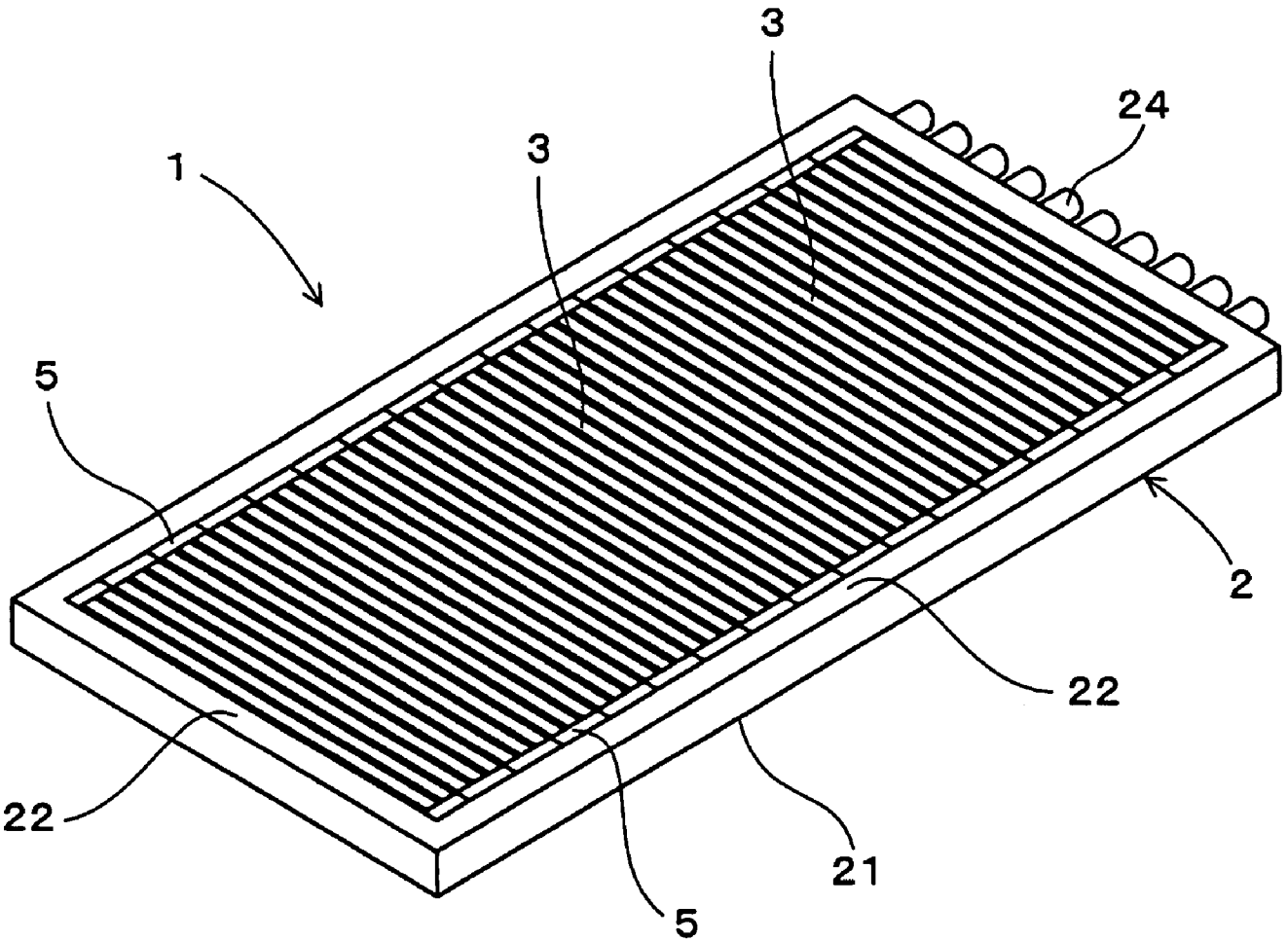
FIG. 1 is perspective view showing suction box in embodiment of the present invention.
Figure 13:
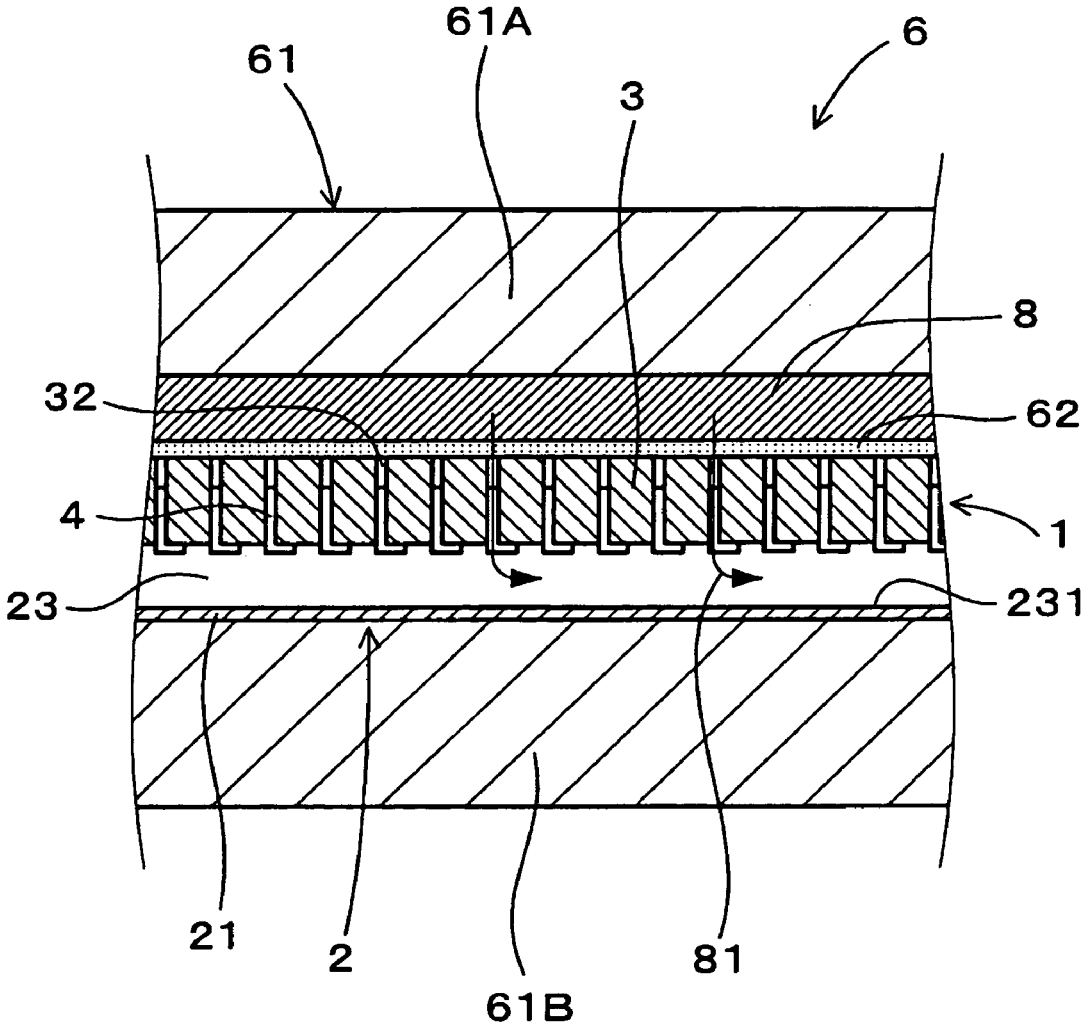
FIG. 13 is sectional drawing showing dehydrator with pressurization using suction box in embodiment.
Figure 14:
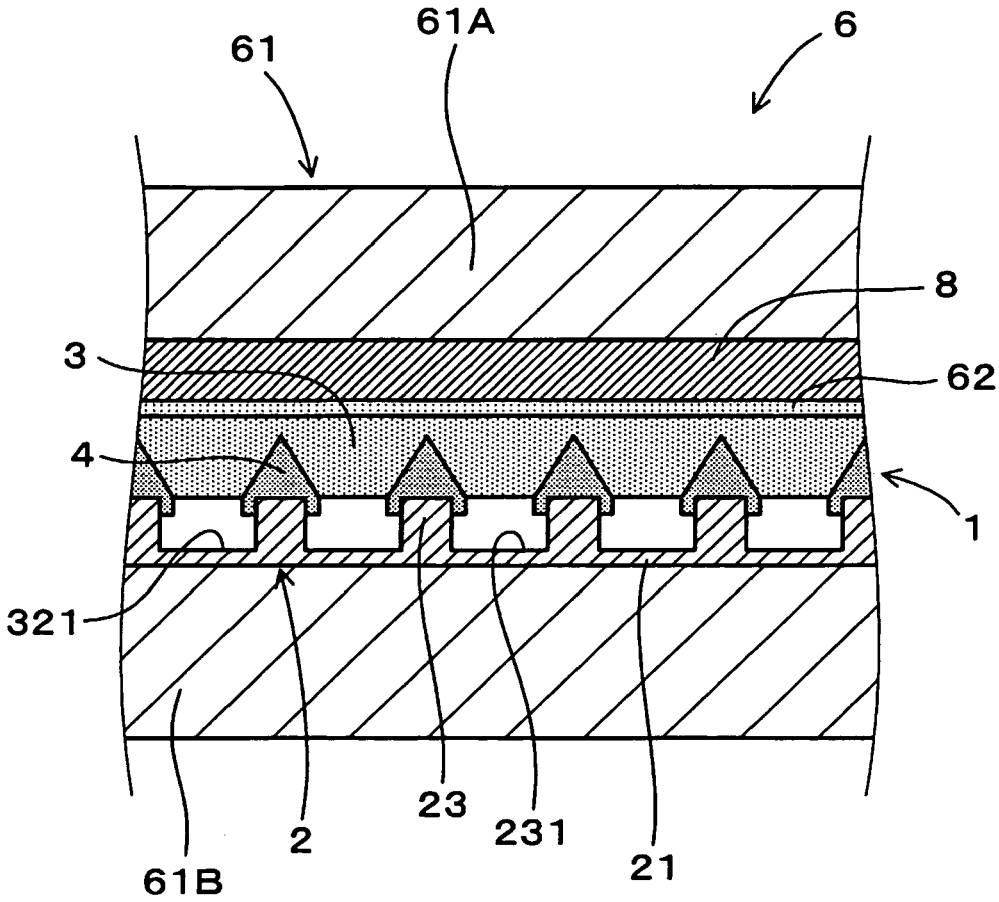
FIG. 14 is sectional drawing showing dehydrator with pressurization using suction box in embodiment.

According to FIGS. 1, 13 and 14, suction box 1 of embodiment uses to dehydrate intermediate of building board 8 containing water 81.

Suction box 1 of embodiment has frame member with bottom plate 2, plural bridge members 3, plural spacer members 4 and a pair of fixture members 5.

According to FIG. 1 to FIG. 4, frame member with bottom plate 2 comprises bottom plate portion 21, outer frame portion 22 formed circumferentially of bottom plate portion 21, plural elongated protruding portions 23 which are on bottom plate portion 21 and are parallel each other, and are extended towards another end by one end.

In addition, plural bridge members 3 are parallel each other, and they are rectangle in the direction which is perpendicular to elongated protruding portions 23, and they are installed on elongated protruding portions 23.

Plural spacer members 4 install on each elongated protruding portions 23 in interval of each bridge members 3 respectively.

A pair of fixture members 5 installs in ends of bridge member 3, and bridge member 3 is fixed to frame member with bottom plate 2.

Suction box 1 of embodiment is explained below in detail with FIG. 1 to FIG. 14.

According to FIG. 1 to FIG. 4, scupper 24 to drain of water drifting to each passages 231 formed between each plural elongated protruding portions 23 in bottom plate portion 21 in external of suction box 1 is formed to outer frame portion 22 in frame member with bottom plate 2. In embodiment, scupper 24 is made for each passages 231 respectively.

In addition, an aspiration hose of vacuum aspiration apparatus is put on to each scuppers 24 in frame member with bottom plate 2, suction box 1 can be aspirated in vacuum.

Figure 4:
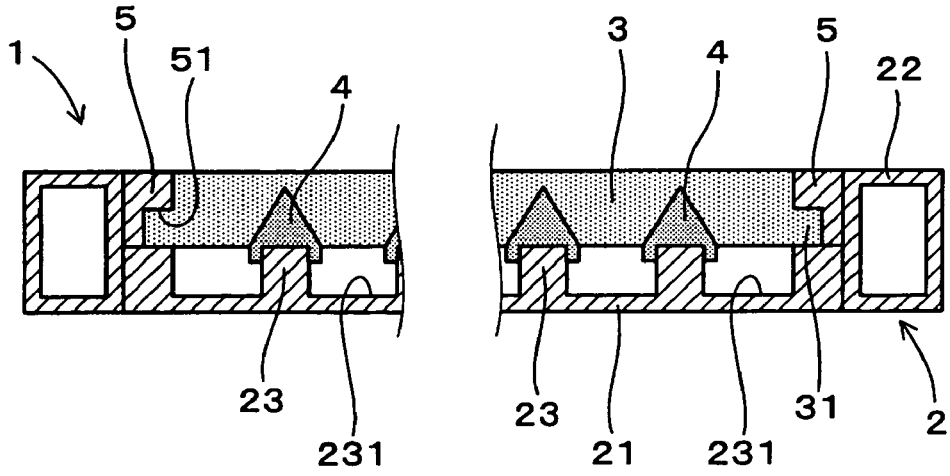
FIG. 4 is cross-sectional view taken along the line B-B shown in FIG. 2, and it is one part of suction box in embodiment of the present invention.
Figure 5:
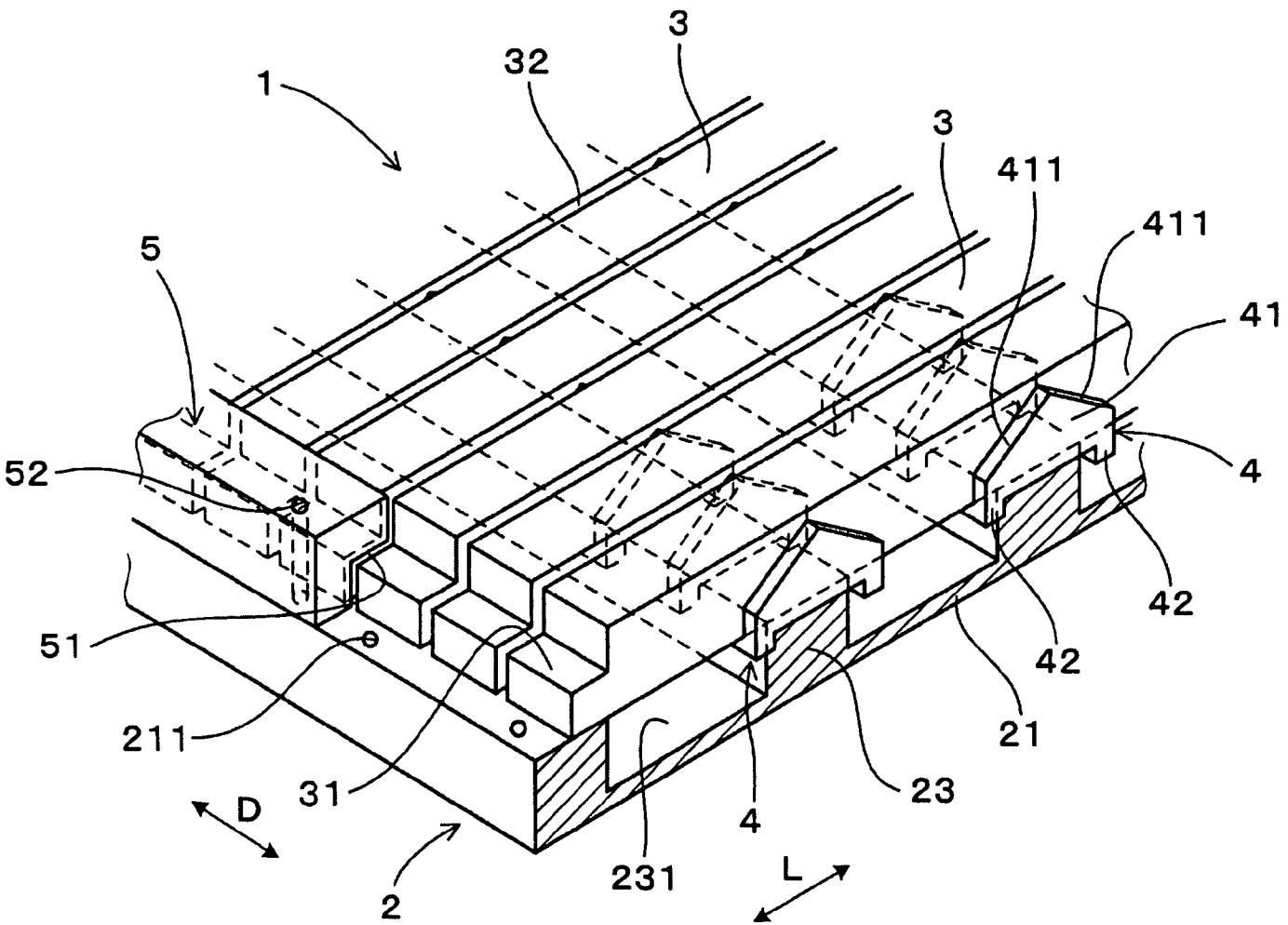
FIG. 5 is perspective view showing the condition which installed bridge members and spacer members in elongated protruding portions of frame member with bottom plate in embodiment of the present invention.

According to FIGS. 4 and 5, bridge member 3 is made from square steel of iron or stainless (profile quadrangle-shaped steel product), bridge member 3 can be worthy of a big pressure.

In ends of bridge member 3, there is engaged portion 31 that is lower height than a general part of bridge member 3 by forming notch in the upper part. And bridge member 3 is fixed by engaging a pair of engaged portions 31 with a pair of fixture members 5.

Figure 7:
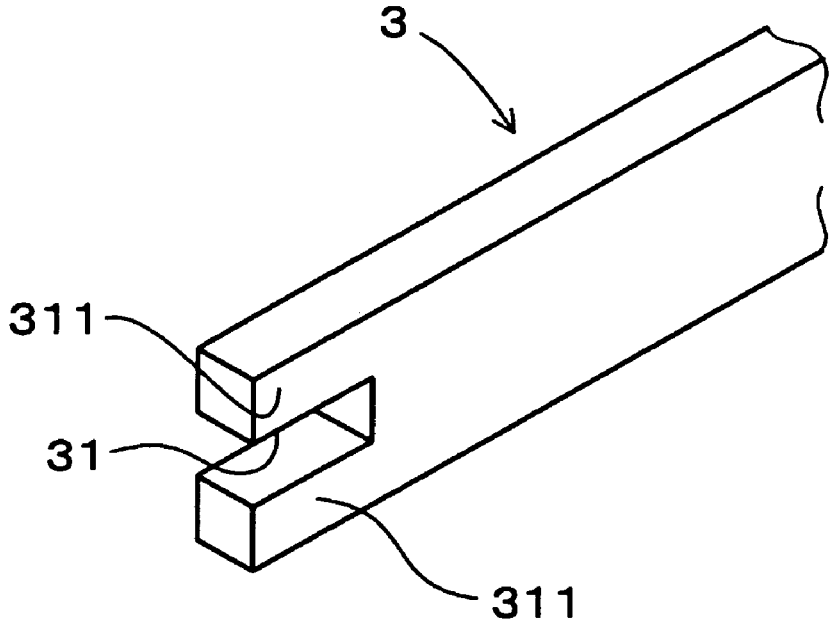
FIG. 7 is perspective view showing other bridge member in embodiment of the present invention.

In addition, according to FIG. 7, engaging portion 31 can be formed from an intermediate part of top and bottom direction in each edge of frame bridge member 3 to core side. In this case, salient portion 311 located in each upper and lower edge of frame bridge member 3 is engaged with fixture member 5, and frame bridge member 3 can fix frame member with bottom plate 2. In embodiment, the thickness to be located in cross direction of bridge member 3 formed by the steel material which was uniformity.

Figure 8:
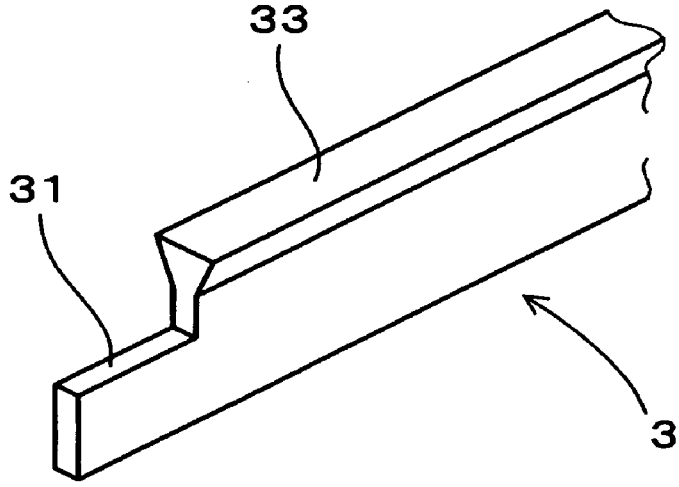
FIG. 8 is perspective view showing other bridge member in embodiment of the present invention.

In contrast, according to FIG. 8, it can be done with bridge member 3 having massive thickness portion 33 that thickness of the upper end is massive in comparison with other portion.

In addition, according to FIG. 5, fixture member 5 has engaging portion 51 engaging engaged portion 31 of bridge member 3. Therefore, in the condition which engaged engaging portion 51 of fixture member 5 to engaged portion 31 of bridge member 3, fixture member 5 can fix bridge member 3 to frame member with bottom plate 2 stably.

To fixture member 5, screw hole 52 that a screw is passed through is formed, in neighborhood of outer frame portion 22 in bottom plate portion 21 of frame member with bottom plate 2, screw hole 211 to engage a screw passed through screw hole 52 in fixture member 5 threadedly is formed.

Figure 2:
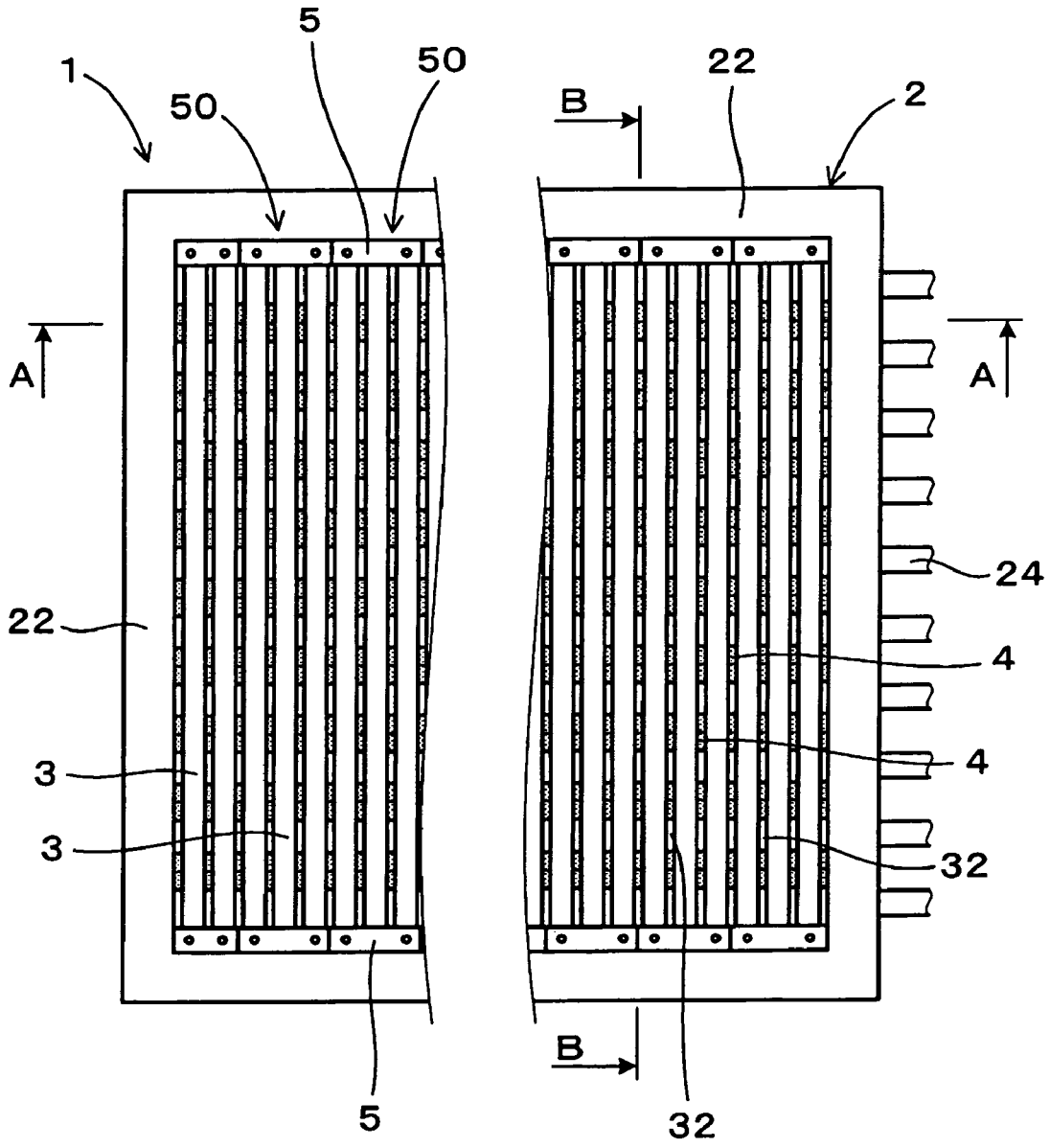
FIG. 2 is plane view to show one part of suction box in embodiment of the present invention.
Figure 3:
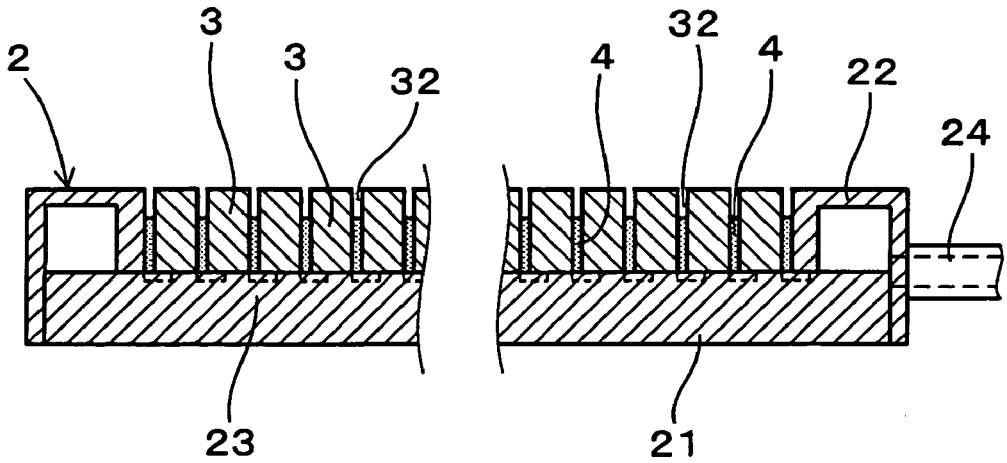
FIG. 3 is cross-sectional view taken along the line A-A shown in FIG. 2, and it is one part of suction box in embodiment of the present invention.
Figure 6:
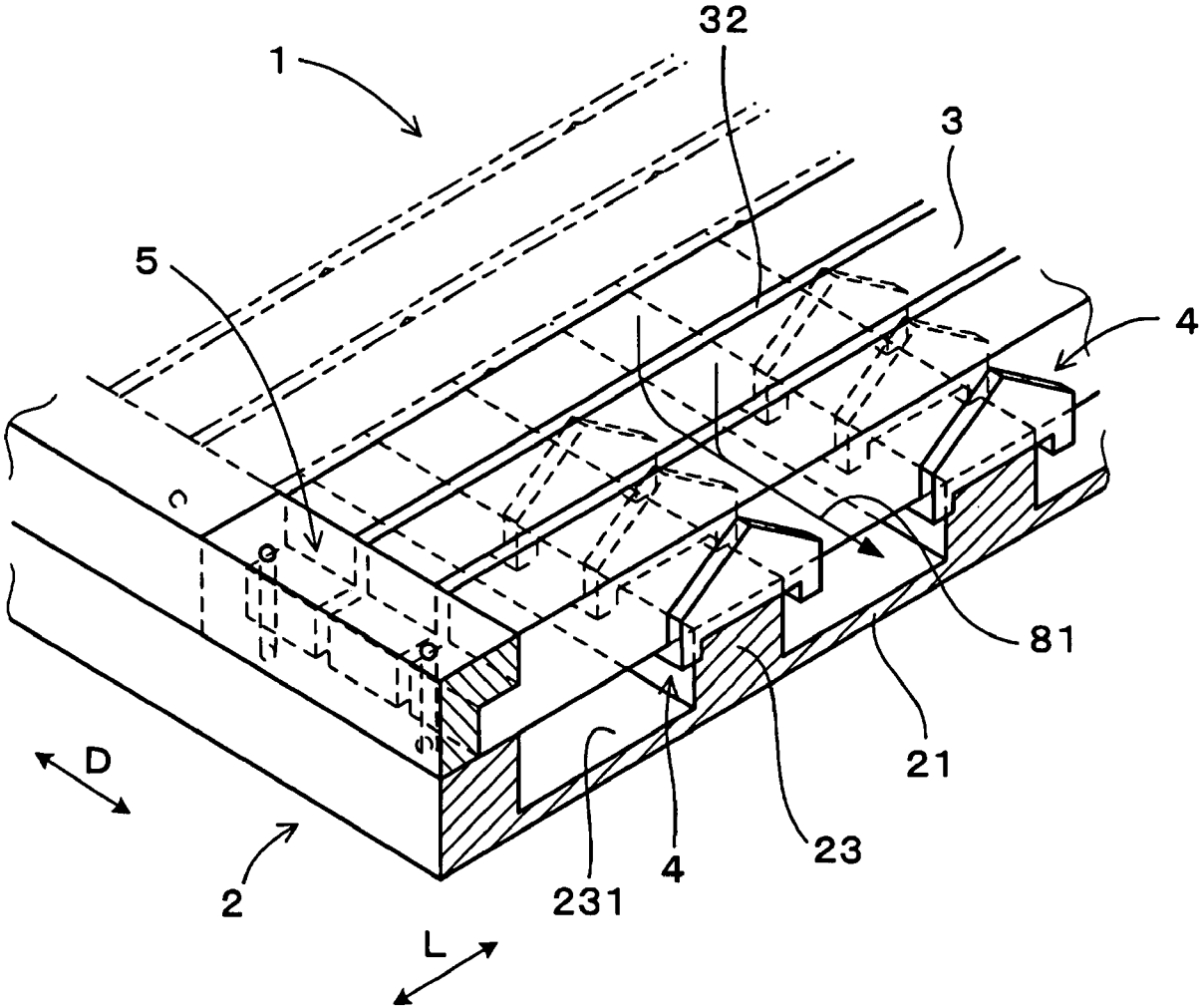
FIG. 6 is perspective view showing the condition which bridge members and spacer members are installed in elongated protruding portions of frame member with bottom plate, and fixed bridge members in frame member with bottom plate by means of fixture members in embodiment of the present invention.

In addition, according to FIGS. 2, 5 and 6, a pair of fixture members 5 forms fixture member group 50 fixing bridge member 3 every predetermined number to frame member with bottom plate 2, the whole of plural bridge members 3 are fixed to frame member with bottom plate 2 by using plural fixture member groups 50. And bridge member 3 can remove by predetermined numbers from frame member with bottom plate 2 by removing either fixture member group 50 among plural fixture member groups 50. By this, for example, only bridge member 3 which needs cleaning is removed from frame member with bottom plate 2 among the whole bridge members 3 by removing either fixture member group 50, and it can be washed.

According to FIG. 4 to FIG. 6, Spacer member 4 comprises spacer main body 41 and a pair of leg portions 42. Spacer main body 41 has a pair of tilting surfaces 411 formed in the shape of a mountain. A pair of leg portions 42 is formed by lower part of spacer main body 41, and it is engaged on both sides of elongated protruding portion 23 in frame member with bottom plate 2, and spacer member 4 can be installed in stability to elongated protruding portion 23 because a pair of leg portions 42 sandwiches elongated protruding portion 23.

In addition, when intermediate of building board 8 is put on suction box 1, and this intermediate of building board 8 is dehydrated, water 81 that dropped on spacer member 4 drifts over a pair of tilting surfaces 411 formed in the shape of a mountain, and it can flow down in suction box 1.

Figure 9:
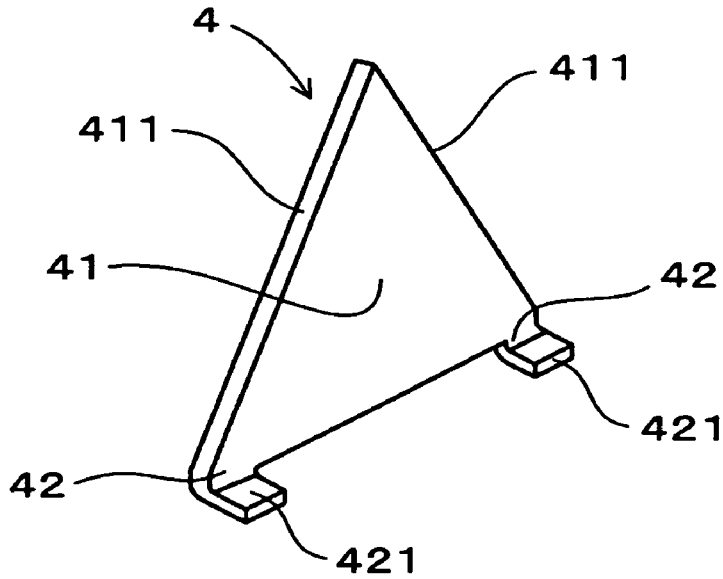
FIG. 9 is perspective view showing spacer member in embodiment of the present invention.

In addition, according to FIG. 9, as for spacer member 4 having a pair of tilting surfaces 411 which is form of mountain in embodiment, a leading edge is a triangle of form of peaky mountain. And a pair of tilting surfaces 411 forms in the whole from the upper end of spacer main body 41 to the lower end.

Figure 10:
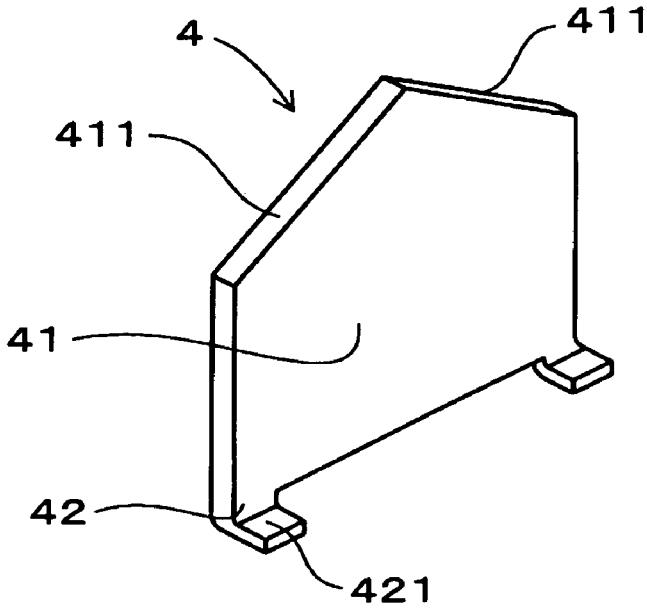
FIG. 10 is perspective view showing other spacer member in embodiment of the present invention.

In contrast, according to FIG. 10, a pair of tilting surfaces 411 which is form of mountain can be formed in the upper part of spacer main body 41.

Figure 11:
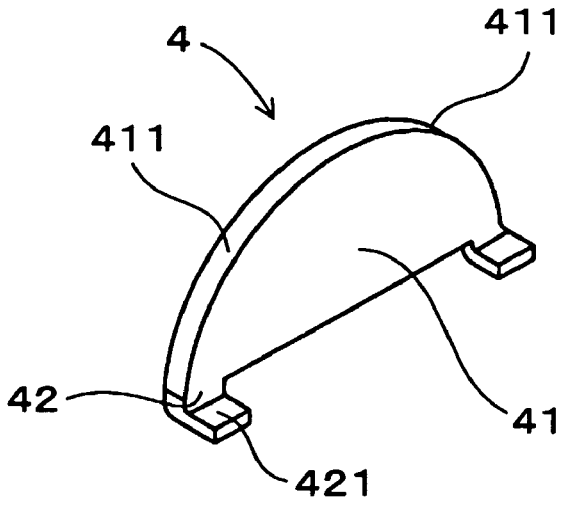
FIG. 11 is perspective view showing other spacer member in embodiment of the present invention.

In addition, according to FIG. 11, a pair of tilting surfaces 411 which is form of mountain can be formed in form of semicircular mountain where a leading edge is round.

Furthermore, a pair of tilting surfaces 411 which is form of mountain can be formed in form of mountain of the trapezium that a leading edge is flush (an illustration is omitted).

In addition, according to FIGS. 5, 6 and 9, a pair of leg portions 42 in spacer member 4 has catching portion 421 making joint to undersurface of bridge member 3 in the edge portion. Formation of this catching portion 421 can prevent that reaction when pressure was freed after vacuum hydration is received, and spacer member 4 put between each bridge member 3 gets away from elongated protruding portion 23 suddenly. In addition, a pair of leg portions 42 in spacer member 4 in embodiment has shape holding edge portion of both sides of elongated protruding portion 23 in frame member with bottom plate 2.

Figure 12:
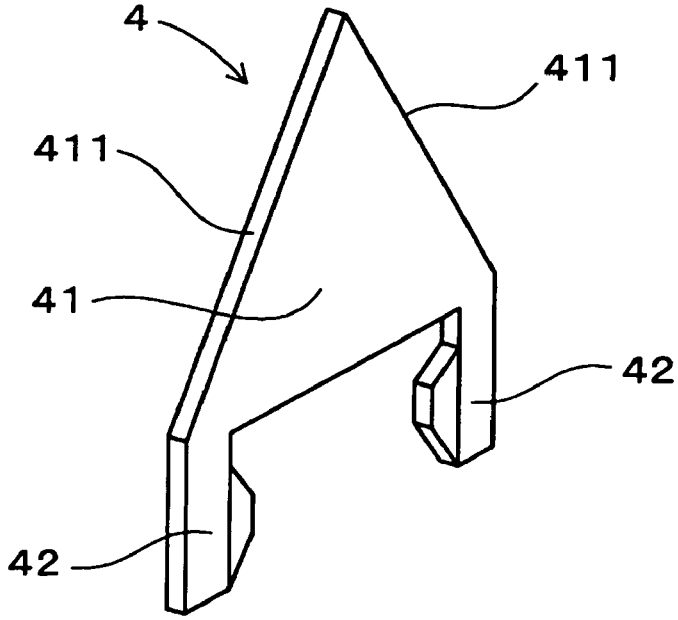
FIG. 12 is perspective view showing other spacer member in embodiment.

In contrast, according to FIG. 12, a pair of leg portions 42 in spacer member 4 can be formed in shape holding the middle portion of both sides of elongated protruding portion 23.

Spacer member 4 has thickness of 2-5 mm. And shape of plural spacer members 4 to apply to suction box 1 are same, width of dehydration space 32 formed between each bridge members 3 is same.

In addition, spacer member 4 can be made various kinds of materials such as iron, stainless, aluminum or plastic etc.

In bridge member 3, thickness of cross direction can be made 6-15 mm, and height can be made 25-60 mm, and, overall length can be made 900-2000 mm. Particularly, thickness of cross direction can be made 9-12 mm, and height can be made 32-50 mm, and overall length can be made 1000-1500 mm.

In addition, thickness of spacer member 4 can be made 2-5 mm.

And space to form between each bridge members 3 becomes same as thickness of spacer member 4.

Cement material, hydraulic inorganic material and siliceous material can be used as material of intermediate of building board 8. And intermediate of building board 8 makes that raw materials is dissolved in water, and it can be molded by wet forming. Forming process Such as Hatschek process, flow on process, filter pressing process or batch method can be used.

For cement material, Portland cement, high early strength Portland cement, Portland blast furnace cement, silica cement, Portland fly-ash cement, high-alumina cement can be used.

In addition, for hydraulic inorganic material, blast furnace slag, quicklime, hydrated lime, gypsum can be used.

In addition, for siliceous material, silica sand, silica powder, fly ash, silica fume, bentonite, diatomaceous earth, mica can be used.

In addition, wood fiber such as wood flake, wood wool, woody pulp, wood fiber bundle, and reinforcement synthetic fiber such as vinylon, polypropylene, and light-weight aggregate such as expanded perlite, shirasu-balloon, and cement accelerator such as aluminum potassium sulfate, sodium silicate, and water repellent such as paraffin, silicon, and styrofoam bise can be incorporated into material of intermediate of building board 8.

Next, assembly procedure of suction box 1 is explained.

On assembling suction box 1, spacer member 4 is installed on plural elongated protruding portions 23 of frame member with bottom plate 2.

Subsequently, on plural elongated protruding portions 23, the first bridge member 3 is put. Then, The first bridge member 3 makes the elongated direction L be perpendicular to formation direction D of elongated protruding portion 23, and it is put. In addition, the first bridge member 3 makes touch spacer main body 41 in each spacer member 4, and it is put (see FIG. 5).

Subsequently spacer members 4 are installed on plural elongated protruding portions 23 respectively.

Then, it makes elongated protruding portion 23 engage a pair of leg portions 42 of spacer member 4, and it makes the spacer main body 41 touch side face of bridge member 3.

In addition, catching portion 421 in a pair of leg portions 42 of spacer member 4 is inserted in undersurface of the first bridge member 3 (see FIG. 5).

Subsequently, on plural elongated protruding portions 23 in frame member with bottom plate 2, the second bridge member 3 is put. Then, it makes the second bridge member 3 touch spacer main body 41 of plural spacer members 4, and it is put on parallelism to the first bridge member 3.

And bridge members 3 of predetermined number are put on elongated protruding portions 23.

Afterwards, fixture member 5 is installed in ends of bridge member 3 of predetermined number respectively, and bridge member 3 is fixed to frame member with bottom plate 2 by means of this fixture member 5 (see FIG. 6).

In addition, catching portion 421 in a pair of leg portions 42 is inserted in undersurface of adjacent bridge member 3 when spacer member 4 is installed in an intermediate position of frame member with bottom plate 2.

When spacer member 4 is installed in edge position of frame member with bottom plate 2, catching portion 421 in a pair of leg portions 42 is inserted in undersurface of outer frame portion 22.

Each bridge members 3 are fixed to frame member with bottom plate 2 by repeating installation of bridge member 3, spacer member 4 and fixture member 5, and suction box 1 can be assembled in this way.

And, between each bridge members 3, dehydration spaces 32 opening to the upper part are formed (it is included between bridge member 3 and outer frame portion 22 in frame member with bottom plate 2).

In addition, as for each spacer members 4, position gap is prevented by a pair of leg portions 42.

Embodiment 2

According to FIGS. 13 and 14, described above suction box 1 is used, and dehydrator with pressurization 6 to dehydrate intermediate of building board 8 is constructed in embodiment. This dehydrator with pressurization 6 has water permeability sheet 62 and a pair of presses 61 on suction box 1. And dehydrator with pressurization 6 is comprised to keep pressurizing suction box 1, water permeability sheet 62 and intermediate of building board 8 to contain water 81 by a pair of presses 61.

Next, procedure dehydrating intermediate of building board 8 by dehydrator with pressurization 6 using of described above suction box 1 is explained.

When intermediate of building board 8 is dehydrated, at first suction box 1, water permeability sheet 62 and intermediate of a building board 8 are put on lower press 61B sequentially. In addition, an aspiration hose of an aspirator is connected to scupper 24 in frame member with bottom plate 2 of suction box 1.

Intermediate of building board 8 of the present embodiment is material slurry, solid content concentration is 25% by mass, and remainder comprises water.

As for the composition of solid content, cement material is 40% by mass, and siliceous material is 48% by mass, and reinforcement fiber is 9% by mass, and light-weight aggregate is 3% by mass.

And vacuum aspiration in suction box 1 is performed by an aspirator, and upper press 61A is dropped for lower press 61B which suction box 1, water permeability sheet 62 and intermediate of building board 8 were put on.

Then, suction box 1, water permeability sheet 62 and intermediate of building board 8 are kept pressurizing between lower press 61B and upper press 61A.

Water 81 included in intermediate of building board 8 falls over dehydration space 32 in suction box 1, and it is aspirated from scupper 24 in this way.

Therefore, it is quick and effective to dehydrate intermediate of building board 8.

In addition, pressurization pressure by a pair of presses 61 is 5.0N/mm2, and aspiration pressure with an aspirator is about −0.35 MPa.

In addition, intermediate of building board 8 was dehydrated, and the building board that water content was 100% was produced (weight of intermediate of building board 8 in humid condition is double as opposed to mass of building board of dry state).

Dehydration rate in intermediate of building board 8 was able to be equalized by dehydrating intermediate of building board 8 using suction box 1 of described above structure.

When intermediate of building board 8 is dehydrated, ingredient in this intermediate of building board 8 flows out on suction box 1, and it happened that effluent accumulates to suction box 1 as inessential.

Particularly, ingredient of intermediate of building board 8 comprises hydraulic inorganic material such as cement, hardening begins in the state which there is water, it is easy to accumulate to suction box 1 as inessential.

Then, in suction box 1 of embodiment, when inessential felt in suction box 1 is removed, bridge member 3 can be removed from frame member with bottom plate 2 by removing fixture member 5. Therefore maintenance of suction box 1 can be performed easily.

In addition, each removed bridge member 3 can be washed individually because every predetermined number can remove bridge member 3. By this, the clogging which occurred to suction box 1 can be easily solved, and hour to need for maintenance can be reduced.

Therefore productivity of building board can be improved.

In suction box 1 of the present embodiment, bridge member 3 is fixed to frame member with bottom plate 2 by using fixture member 5, it is not necessary to form fastening hole to fix to frame member with bottom plate 2 to bridge member 3 directly.

Therefore it can make reduce manufacturing cost of suction box 1.

In addition, application number of bridge member 3 is changed by performing changes of thickness of spacer member 4 to use, and opening area ratio of dehydration space 32 formed between each bridge members 3 can be changed easily.

Therefore, pressurization pressure by a pair of presses 61 of dehydrator with pressurization 6 and aspiration force with an aspirator are accepted, and opening area ratio of dehydration space 32 can be changed in the opening area ratio which was suitable for dehydration of building board intermediate easily.

In addition, opening area ratio of dehydration space 32 shows opening area by space formed between each bridge members 3 (it is included between bridge member 3 and outer frame portion 22 in frame member with bottom plate 2).

Embodiment 3

Figure 15:
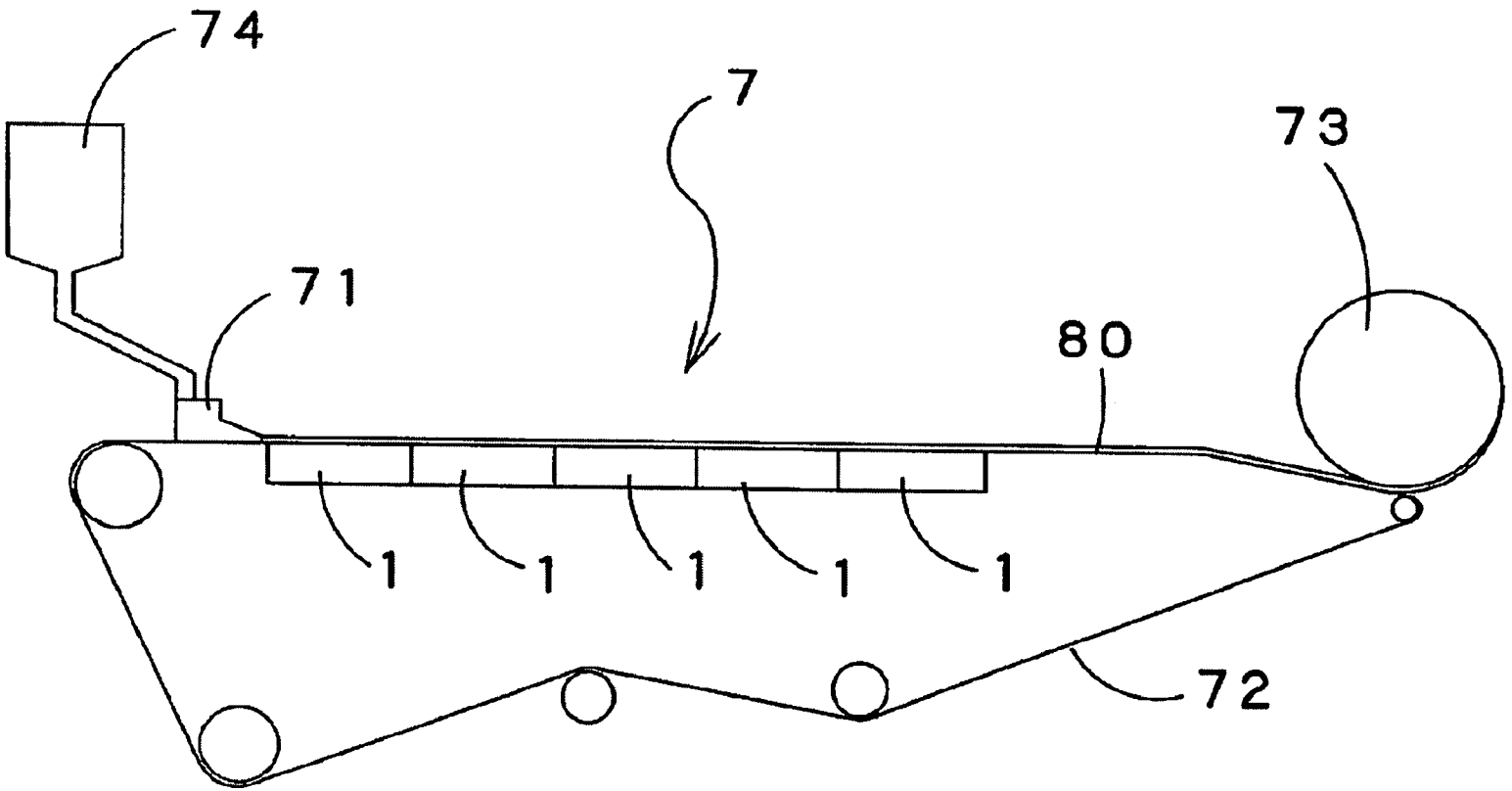
FIG. 15 is sectional drawing showing forming machine using suction box in embodiment.
Figure 16:
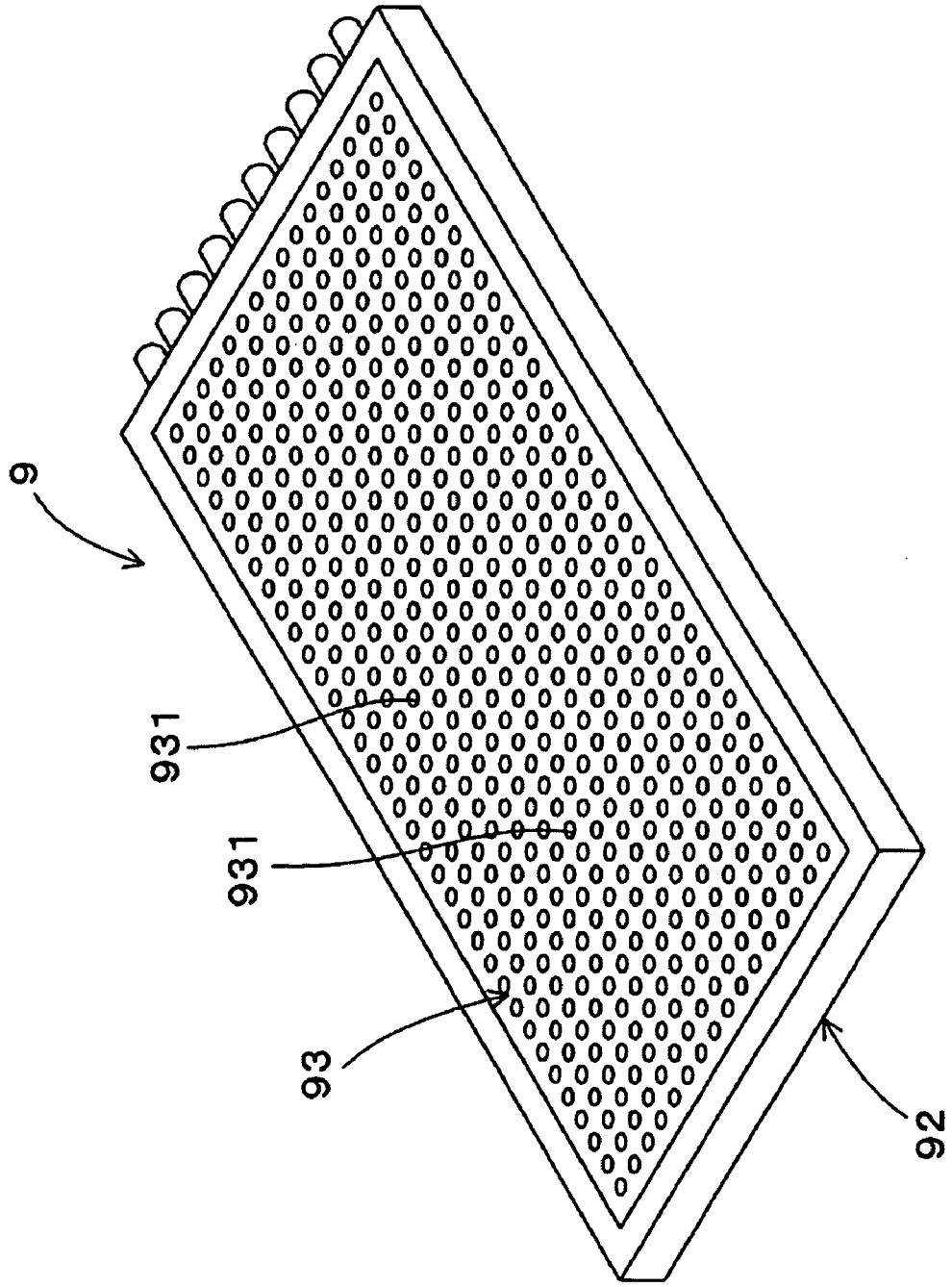
FIG. 16 PRIOR ART
FIG. 16 is perspective view showing suction box in conventional embodiment.
Figure 17:
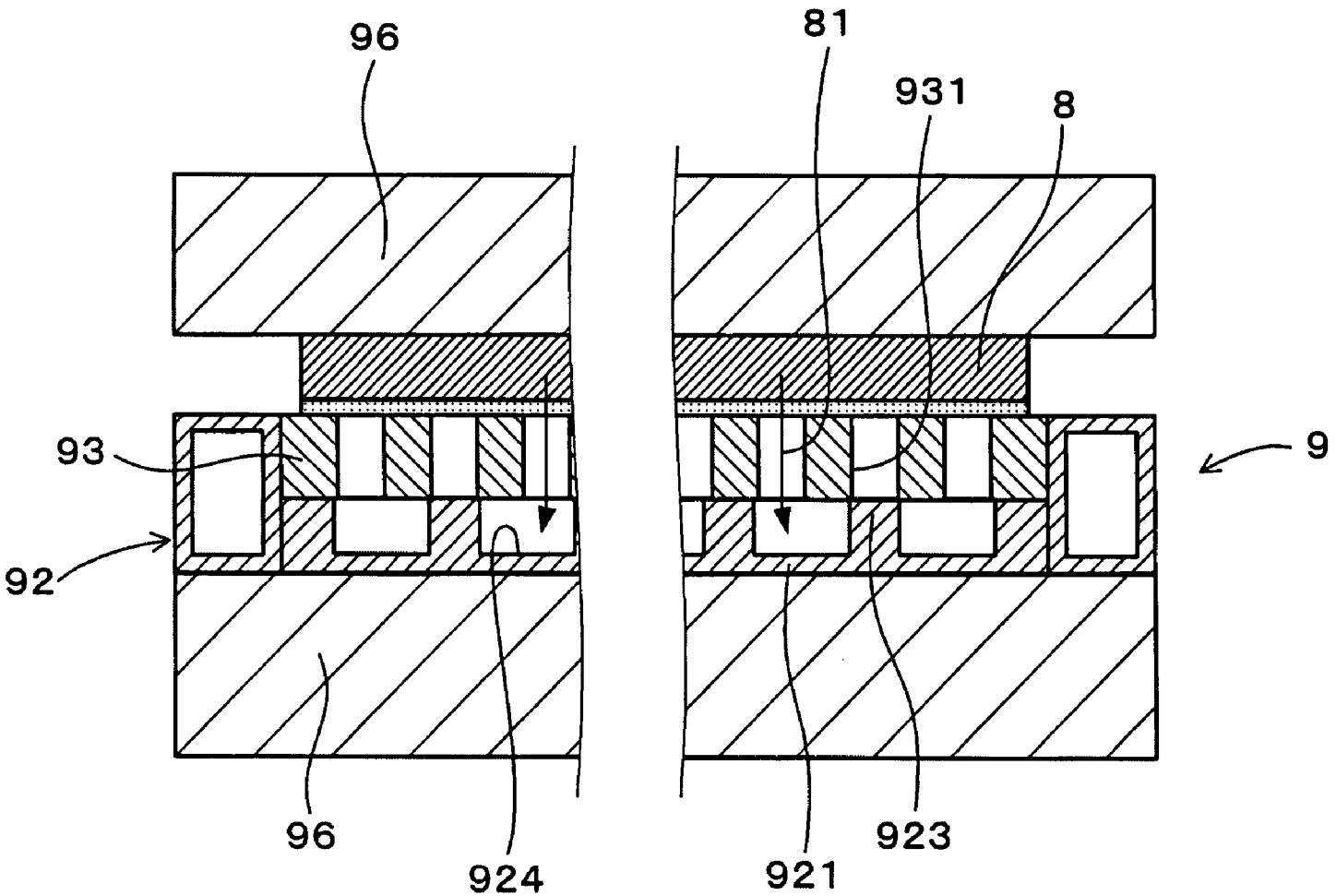
FIG. 17 PRIOR ART
FIG. 17 is sectional drawing showing dehydrator with pressurization using suction box in conventional embodiment.

According to FIG. 15, in embodiment, forming machine 7 to dehydrate material slurry 80 for inorganic building board manufacturing is comprised by using described above suction box 1.

Material slurry 80 is supplied to flow box 71 from tank 74. And material slurry 80 flows down on endless water permeability sheet 72 from flow box 71. Endless water permeability sheet 72 rotates between flow box 71 and making roll 73. Suction box 1 is placed under endless water permeability sheet 72.

Water 81 is aspirated from under endless water permeability sheet 72, and it is dehydrated. Material slurry 80 that water content went low by being aspirated forms sheet shape.

Afterwards, it is rolled up to making roll 73, and predetermined thickness was become, and it is separated from making roll 73, and it is green mat.

Aspiration force and number of suction box 1 are changed by concentration of material slurry 80 and transport speed of endless water permeability sheet 72, and appropriate dehydration is performed.

Here, it was explained in forming machine of so-called flow on process. However, Hatschek process, filter pressing process and batch process etc. are the same.

Forming machine 7 is not pressing with press such as dehydrator with pressurization 6, but a facility, an effect and constitution as suction box 1 are the same.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.q., of aspects across various embodiments), adaptations and/or alterations as would be appreciated by those in the art based on the present disclosure.

The limitations in the claims are to be interpreted broadly based on the language employed in the claims and not limited to examples described in the present specification or during the prosecution of the application, which examples are to be construed as non-exclusive.

For example, in the present disclosure, the term "preferably" is non-exclusive and means "preferably, but not limited to".

In this disclosure and during the prosecution of this application, the terminology "present invention" or "invention" is meant as a non-specific, general reference and may be used as a reference to one or more aspect within the present disclosure.

The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims.

In this disclosure and during the prosecution of this application, the terminology "embodiment" can be used to describe any aspect, feature, process or step, any combination thereof, and/or any portion thereof, etc.

In some examples, various embodiments may include overlapping features.

What is claimed is:

1. A dehydrator with pressurization, which comprises a suction box, a water permeability sheet, and a pair of presses, wherein:

the suction box comprises a frame member with a bottom plate, plural bridge members, plural spacer members and a pair of fixture members, wherein the frame member with the bottom plate comprises a bottom plate portion, an outer frame portion formed circumferentially of the bottom plate portion and plural elongated protruding portions formed on the bottom plate portion, wherein the plural elongated protruding portions are parallel to each other and are elongated from one end towards another end, wherein the plural bridge members are parallel to each other and are rectangular in a direction that is perpendicular to the elongated protruding portions formed on the bottom plate portion, wherein the plural spacer members are placed on each of the elongated protruding portions in intervals between the bridge members, and wherein the pair of fixture members is installed in ends of the bridge members and the bridge members are fixed in the frame member with the bottom plate;

the water permeability sheet is placed over the suction box; and the pair of presses pressurizes the suction box, the water permeability sheet and the intermediate of inorganic building board containing water.

2. A dehydrator with pressurization, which comprises a suction box, a water permeability sheet, and a pair of presses, wherein:

the suction box comprises a frame member with a bottom plate, plural bridge members, plural spacer members and a pair of fixture members, wherein the frame member with the bottom plate comprises a bottom plate portion, an outer frame portion formed circumferentially of the bottom plate portion and plural elongated protruding portions formed on the bottom plate portion, wherein the plural elongated protruding portions are parallel to each other and are elongated from one end towards another end, wherein the plural bridge members are parallel to each other and are rectangular in a direction that is perpendicular to the elongated protruding portions formed on the bottom plate portion, wherein the plural spacer members are placed on each of the elongated protruding portions in intervals between the bridge members, and wherein the pair of fixture members is installed in ends of the bridge member and the bridge member is fixed in the frame member with the bottom plate;

the spacer member comprises a spacer main body and a pair of leg portions, the spacer main body comprises a pair of tilting surfaces formed in the shape of a mountain, and the pair of leg portions is formed in a lower part of the spacer main body and are engaged on both sides of elongated protruding portion;

the water permeability sheet is placed over the suction box; and the pair of presses pressurizes the suction box, the water permeability sheet and the intermediate of inorganic building board containing water.

3. A dehydrator with pressurization, which comprises a suction box, a water permeability sheet, and a pair of presses, wherein:

the suction box comprises a frame member with a bottom plate, plural bridge members, plural spacer members and a pair of fixture members, wherein the frame member with the bottom plate comprises a bottom plate portion, an outer frame portion formed circumferentially of the bottom plate portion and plural elongated protruding portions formed on the bottom plate portion, wherein the plural elongated protruding portions are parallel to each other and are elongated from one end towards another end, wherein the plural bridge members are parallel to each other and are rectangular in a direction that is perpendicular to the elongated protruding portions formed on the bottom plate portion, wherein the plural spacer members are placed on each of the elongated protruding portions in intervals between the bridge members, wherein the pair of fixture members is installed in ends of the bridge member and the bridge member is fixed in the frame member with the bottom plate, and wherein the pair of fixture members have an overall length to fix a predetermined number of bridge members in the frame member with the bottom plate;

the water permeability sheet is placed over the suction box; and the pair of presses pressurizes the suction box, the water permeability sheet and the intermediate of inorganic building board containing water.

* * * * *